US009174219B2

(12) United States Patent
Lucas et al.

(10) Patent No.: US 9,174,219 B2
(45) **Date of Patent: *Nov. 3, 2015**

(54) PADDLE ASSEMBLY

(71) Applicant: Scott Equipment Company, New Prague, MN (US)

(72) Inventors: Richard V. Lucas, Jordan, MN (US); Glen A. Jeurissen, Belle Plaine, MN (US); Richard R. Lucas, Jordan, MN (US)

(73) Assignee: Scott Equipment Company, New Prague, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/267,402

(22) Filed: May 1, 2014

(65) Prior Publication Data

US 2014/0239105 A1 Aug. 28, 2014

Related U.S. Application Data

(63) Continuation of application No. 13/686,180, filed on Nov. 27, 2012, now Pat. No. 8,727,254.

(60) Provisional application No. 61/588,953, filed on Jan. 20, 2012.

(51) Int. Cl.

| | |
|---|---|
| ***B02C 13/28*** | (2006.01) |
| ***B02C 13/31*** | (2006.01) |
| *B02C 13/06* | (2006.01) |

(52) U.S. Cl.

CPC ..... *B02C 13/28* (2013.01); *B02C 13/2804* (2013.01); *B02C 13/31* (2013.01); *B02C 13/06* (2013.01)

(58) Field of Classification Search

CPC .. B02C 13/282; B02C 13/2804; B02C 13/14; B02C 13/06; B02C 13/28; B02C 23/02; B02C 23/04; B02C 13/31; A01F 29/095

USPC ..... 241/32, 188.1, 191, 192, 194, 195

See application file for complete search history.

(56) References Cited

U.S. PATENT DOCUMENTS

| | | | | |
|---|---|---|---|---|
| 978,536 | A * | 12/1910 | Bach | 241/32 |
| 1,967,323 | A | 8/1931 | Pettibone | |
| 2,700,511 | A | 1/1955 | Denovan et al. | |
| 2,869,842 | A | 1/1959 | Schmidt | |
| 3,157,366 | A | 11/1964 | Rogers | |
| 3,880,366 | A | 4/1975 | Loevenich | |
| 3,973,735 | A | 8/1976 | Ito et al. | |
| 4,129,260 | A | 12/1978 | Baker | |
| 4,369,548 | A | 1/1983 | Malinak | |
| 5,887,808 | A | 3/1999 | Lucas | |
| 6,248,156 | B1 | 6/2001 | Lucas | |
| 6,713,112 | B1 | 3/2004 | Lucas | |
| 6,893,862 | B1 | 5/2005 | Horn et al. | |
| 2004/0076726 | A1 | 4/2004 | Lucas | |
| 2011/0186664 | A1 | 8/2011 | Lucas et al. | |

* cited by examiner

*Primary Examiner* — Faye Francis
*Assistant Examiner* — Onekki Jolly
(74) *Attorney, Agent, or Firm* — Vidas, Arrett & Steinkraus

(57) ABSTRACT

A radially projecting member (e.g., a paddle assembly) including a pin having a head; a paddle pivotally engaged to the head; and a shear member engaged to the head and to the paddle, the shear member being constructed and arranged to fracture to permit pivotal rotation of the paddle relative to the head.

11 Claims, 4 Drawing Sheets

PADDLE ASSEMBLY

CROSS-REFERENCE TO RELATED APPLICATIONS

This application is a continuation application of U.S. patent application Ser. No. 13/686,180, filed Nov. 27, 2012 which claims the benefit of U.S. Provisional Patent Application Ser. No. 61/588,953, which was filed Jan. 20, 2012, entitled "Separator Paddle Assembly," all of which is incorporated herein by reference in its entireties.

STATEMENT REGARDING FEDERALLY SPONSORED RESEARCH

Not applicable.

BACKGROUND

This invention relates to the field of paddle assemblies, for example, paddle assemblies used in separating, grinding, comminuting, breaking, and otherwise processing a material. For example, paddle assemblies may be used in continuous flow material processing equipment, which may grind and/or otherwise refine a material to be processed.

It is desirable in a wide variety of industries to process materials (e.g., organic materials, inorganic materials, mixtures thereof, etc.). For example, it may be desirable to separate and/or grind a particular material to prepare the material for a downstream application and/or subsequent processing. In some instances, the processing may include contacting a material to be processed with one or more paddles for the purpose of separating, grinding, comminuting, breaking, and otherwise processing a material.

For example, grinding and comminuting apparatus are used for reducing the size of materials, such as food products, chemicals, rubbers, resins, garbage (e.g., food waste), wastepaper, wood chips, waste fiber (e.g., cloth, gypsum), plastics, glass, metal chips, or the like. Conventional grinding/comminuting apparatus, such as that disclosed in U.S. Pat. No. 4,129,260, issued Dec. 12, 1978 to Baker, entitled Garbage Disposal, and U.S. Pat. No. 3,973,735, issued Aug. 10, 1976 to Ito et al., entitled Apparatus For Pulverizing And Sorting Municipal Waste, typically include a grinding chamber with high speed rotating beaters/hammers that tear, shred, slash, cut, and/or grind one or more desired products to a desired size.

However, depending on the material contacted by the paddles, the processing conditions, and the construction of the paddle assemblies (e.g., including the engagement thereof to a rotating drive shaft), obstructions that contact the paddles have been known to damage (e.g., breaking, bending, plastically deforming, etc.) rotating paddle assemblies and/or other portions of the processing equipment (e.g., drive shaft, drive source, etc.). Repairing or replacing paddle assemblies and other portions of the processing equipment can be costly, due to, for example, increased capital and labor expense, as well as increased downtime.

In some processing equipment, the failure of a single paddle assembly has been known to cause damage to one or more additional paddle assemblies or may otherwise reduce the processing efficiency of the processing equipment to an undesirable level. The reduced processing efficiency may require prematurely shutting down the processing equipment to repair the single damaged paddle assembly, resulting in decreased processing time and increased downtime.

Thus, improved paddle assemblies and processing equipment are desired to, for example, reduce maintenance time, maintenance expense, and/or processing equipment downtime.

BRIEF SUMMARY

Without limiting the scope of the invention a brief summary of some of the claimed embodiments of the invention is set forth below. Additional details of the summarized embodiments of the invention and/or additional embodiments of the invention may be found in the Detailed Description of the Invention below.

In one aspect of the present disclosure, a separator/grinding apparatus is provided. The separator/grinding apparatus may include a substantially hollow chamber having an inside wall, a drive shaft that extends through at least a portion of the chamber, a plurality of radially projecting members that project from the drive shaft, and a drive source engaged to the drive shaft and constructed and arranged to rotate the drive shaft. In one or more embodiments, at least one of the radially projecting members may include a pin having a head; a paddle; and a shear member constructed and arranged to fracture to permit pivotal rotation of the paddle relative to the head. In one or more embodiments, the paddle may have a first side and a second side, the second side having engaged therewith at least one side plate pivotally engaged to the head.

In one or more embodiments, the first side may include a striking face for contacting material to be processed. In one or more embodiments, the plurality of radially projecting members may be constructed and arranged in the chamber to grind a material to be processed.

In one or more embodiments, a separator/grinding apparatus may include a gate. The chamber may include an opening selectively coverable by the gate. The gate may be pivotally engaged to the chamber and may have an open position wherein the opening is at least partially uncovered and a closed position wherein the opening is covered (e.g., completely covered).

In another aspect of the present disclosure, a method of maintaining the separator/grinding apparatus is provided. The method of maintaining the separator grinding apparatus may include replacing a fractured shear member with a replacement shear member.

In another aspect of the present disclosure, a paddle assembly (e.g., a separator paddle assembly) is provided, which may include a pin having a head; and a paddle having a first side and a second side, the second side having engaged therewith at least one side plate pivotally engaged to the head, the at least one side plate engaging a shear member constructed and arranged to fracture to permit pivotal rotation of the paddle relative to the head.

In one or more embodiments, the second side of the paddle may have engaged therewith at least two side plates pivotably engaged to the head. In one or more embodiments, the head may include at least one aperture, the at least one side plate may include at least one aperture, and the shear member may be constructed and arranged to extend through the at least one aperture of the head and the at least one aperture of the at least one side plate. In one or more embodiments, a pivot member may be constructed and arranged to extend through at least one aperture in the head and at least one aperture of the at least one side plate.

In another aspect of the present disclosure, a radially projecting member (e.g., a paddle assembly, a separator paddle assembly, etc.) may include a pin having a head; a paddle pivotally engaged to the head; and a shear member constructed and arranged to fracture to permit pivotal rotation of the paddle relative to the head.

In one or more embodiments the paddle may include a first side, the head may include a first side, and the first side of the paddle and the first side of the head may collectively form a striking surface. In one or more embodiments, the first side of the paddle may be adjacent to the first side of the head. In one or more embodiments, the paddle may include a slot and is configured to receive the head in the slot. In one or more embodiments, the shape of the head and the shape of the slot may be configured to allow pivotal rotation of the paddle relative to the head in at least one rotational direction. In one or more embodiments, the paddle may be pivotably engaged to the head via a pivot member that may extend through a head aperture and a side plate aperture.

In one or more embodiments, a shear member may be constructed and arranged to fracture upon application of a predetermined amount of shear force to the shear member as a result of application of a corresponding force to the paddle. In one or more embodiments, the corresponding force applied to the paddle is not sufficient to cause damage to the radially projecting member.

These and other embodiments are pointed out with particularity in the claims annexed hereto and forming a part hereof. However, for a better understanding of the present disclosure, including advantages and objectives obtained by use of the processing equipment (e.g., separator/grinding apparatus, paddle assemblies, etc.), reference can be made to the drawings which form a further part hereof and the accompanying descriptive matter, in which there are illustrated and described various embodiments of the present disclosure.

BRIEF DESCRIPTION OF THE DRAWINGS

A detailed description is hereafter provided with specific reference being made to the drawings.

DETAILED DESCRIPTION

Figure 1:
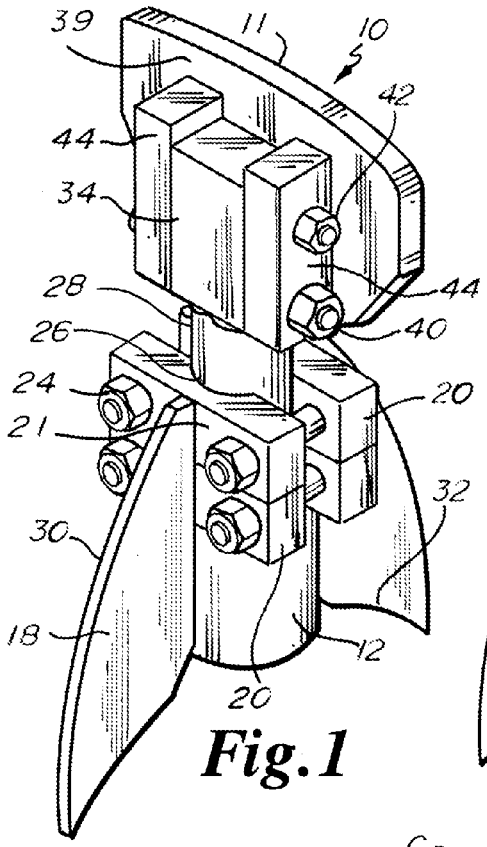
FIG. 1 is a perspective view of at least one exemplary embodiment of a paddle assembly in accordance with the present disclosure.

For the purposes of this disclosure, like reference numerals in the figures shall refer to like features unless otherwise indicated.

The present disclosure is generally directed to a paddle assembly 10 for use in, for example, a separator/grinding apparatus. Various features and operation of a separator/grinding apparatus are disclosed in U.S. Pat. Appl. Pub. No. 2011/0186664 A1 (U.S. patent application Ser. No. 12/760,714, filed Apr. 15, 2010 by Lucas et al. and entitled "Dryer/Grinder"); U.S. Pat. Appl. Ser. No. 61/299,788 (filed Jan. 29, 2010 by Lucas et al. and entitled "Dryer/Grinder"); U.S. Pat. Appl. Pub. No. 2004/0076726 A1 (U.S. patent application Ser. No. 10/611,241, filed Jun. 30, 2003 by Lucas and entitled "Apparatus and Process for Continuous Pressurized Conditioner System"); U.S. Pat. Appl. Ser. No. 60/419,616 (filed Oct. 18, 2002 by Lucas and entitled "Apparatus and Process for Continuous Pressurized Conditioner System"); U.S. Pat. No. 6,713,112 (issued Mar. 30, 2004 to Lucas and entitled "Meal Cooler Centrifugal Separator"); U.S. application Ser. No. 09/659,909 (filed Sep. 12, 2000 by Lucas and entitled "Meal Cooler Centrifugal Separator"); U.S. Pat. No. 5,887,808 (issued Mar. 30, 1999 to Lucas and entitled "High Efficiency Grinding Apparatus"); U.S. Pat. No. 6,248,156 (issued Jun. 19, 2001 to Lucas and entitled "Particulate Capture System and Method of Use"), the entire contents all of which are incorporated by reference herein in their entireties.

A separator/grinding apparatus of the present disclosure may include a substantially hollow chamber having an inside wall and a drive shaft that extends through at least a portion of the chamber. The separator/grinding apparatus may also include a plurality of radially projecting members (e.g., a plurality of paddle assemblies) that project from the drive shaft.

In one or more embodiments, the separator/grinding apparatus may also include a drive source engaged to the drive shaft, wherein the drive source is constructed and arranged to rotate the drive shaft. One of skill in the art will recognized a wide variety of drive sources that may be utilized in one or more embodiments of the present disclosure.

In one or more embodiments of the separator/grinding apparatus, at least one of the radially projecting members may include a pin having a head, a paddle, and a shear member constructed and arranged to fracture to permit pivotal rotation of the paddle relative to the head. A paddle may have a first side and a second side. The second side of the paddle may have engaged therewith at least one side plate pivotally engaged to the head. In one or more embodiments, the paddle may be pivotably engaged to the head via a pivot member that, for example, extends through a head aperture and a side plate aperture.

One or more embodiments of a paddle assembly are depicted in FIG. 1. The paddle assembly 10 may include a collar 12, which may be welded to a rotatable shaft 16 (FIG.

10). In some embodiments one or more gussets 18 are permanently affixed to the exterior of the collar 12 by welding where the gussets 18 assist in the separation, mixing, and/or grinding of material deposited within a separator/grinding apparatus (not shown), which may have a substantially hollow cylindrical chamber having an inside wall (not shown). In an alternative embodiment, the one or more gussets 18 may be securely affixed to one or more support plates 20, extending outwardly therefrom. In at least one embodiment, the second engagement edge 32 of each gusset 18 may be welded to the exterior surface of the rotatable shaft 16.

Figure 2:
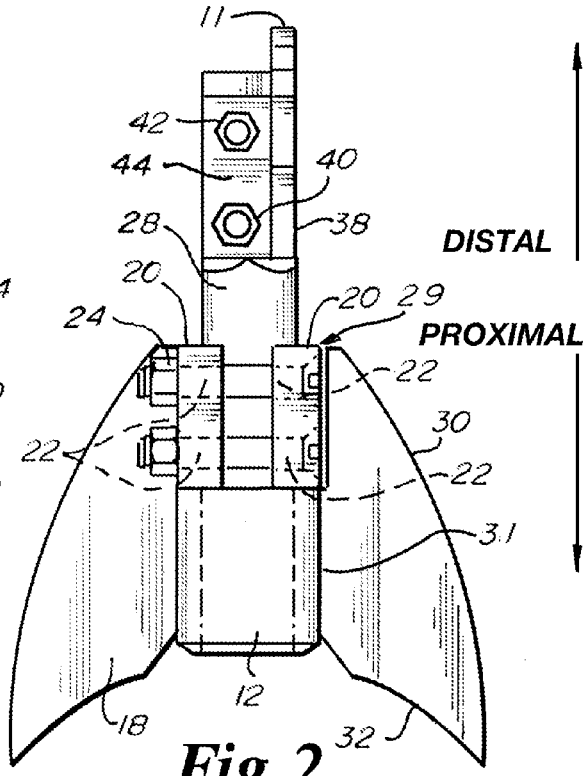
FIG. 2 is a side elevation view, showing selected interior details, of at least one exemplary embodiment of a paddle assembly in accordance with the present disclosure.

With reference to FIG. 2, in at least one embodiment, at least one of support plates 20, 21 may include a plurality of apertures 22, which may be adapted to receive connecting members, such as bolts and nuts 24. Support plates 20, 21 may include a recess, which may be sized to receive therein a portion of a pin 28. For example, as shown in FIG. 1, centrally disposed on one side of each of the support plates 20, 21 is an arcuate cutout area 26 (e.g., a recess), which is sized to engage an exterior surface (e.g., cylindrical exterior surface) of a pin 28. In at least one embodiment, support plates 20, 21 may function as a portion of a clamp to releasably secure a pin 28 to a collar 12. (FIG. 2) As may be seen in FIGS. 1 and 2, a plurality of bolts and nuts 24 are disposed through the apertures 22 to secure the support plates 20, 21 on opposite sides of pin 28. As further described herein, releasably securing support plates 20, 21 to the pin 28 and/or collar 12 may allow for adjustment of the angular position of paddle 11 by, for example, rotating pin 28 about longitudinal axis C (see FIG. 3) to a desired angular position.

Figure 7:
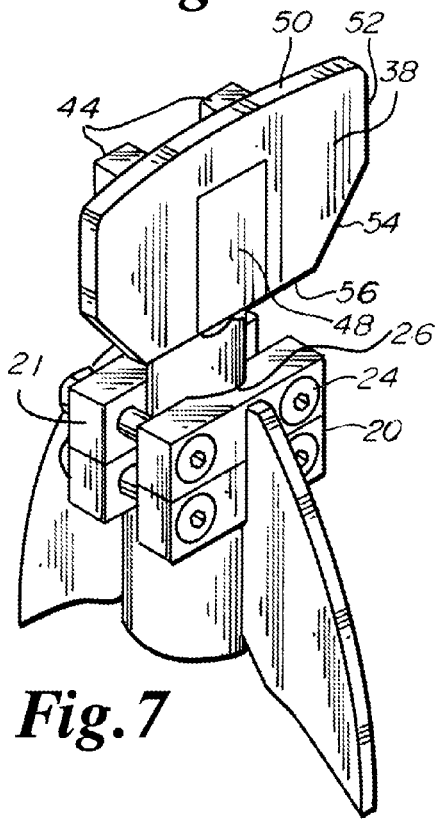
FIG. 7 is an isometric perspective view of at least one exemplary embodiment of a paddle assembly in accordance with the present disclosure.

As may be seen in FIGS. 1 and 7 each rear support plate 21 may be formed of one or more sections or members. In some embodiments, if rear support plate 21 is formed of one or more members or sections, then the members or sections may be permanently secured to each other by welding, and the rear support plate 21 may be welded to the rear or back side of collar 12 and panel assembly 10. In other alternative embodiments, rear support plate 21 is a unitary member which may be permanently affixed to the back/rear side of paddle assembly 10 by welding and to the gussets 18 and/or collar 12 by welding.

In at least one embodiment as shown in FIGS. 1 and 7 the support plate 20 on the first side of pin 28 is formed of one, two, or more members, where each support plate 20 has apertures 22 being constructed and arranged for alignment with apertures 22 through rear support plate 21 on the rear or back side of paddle assembly 10. In some embodiments, the support plate 20 on the front side of paddle assembly 10 (whether being formed of one or more members) is disposed on the opposite side of a pin 28 relative to the rear support plate 21, which may be permanently engaged to one or more gussets 18, and/or collar 12. In alternative embodiments, the support plate 20 on the front side of paddle assembly 10 is releasably engaged to the rear support plate 21 through the use of bolts and nuts 24. The tightening of bolts and nuts 24 as disposed through aligned apertures 22 of the front and rear support plates 20, 21 respectively, will in some embodiments function as a clamp to grasp the pin 28, to orient the first face 38 at a desired angle relative to the longitudinal access "C" of the shaft 16.

Figure 5:
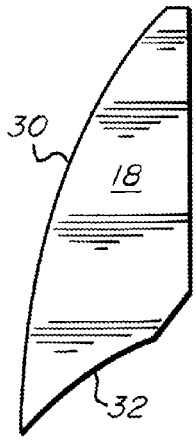
FIG. 5 is a detail view of at least one exemplary embodiment of a gusset, which may be utilized in one or more embodiments of the present disclosure.
Figure 11:
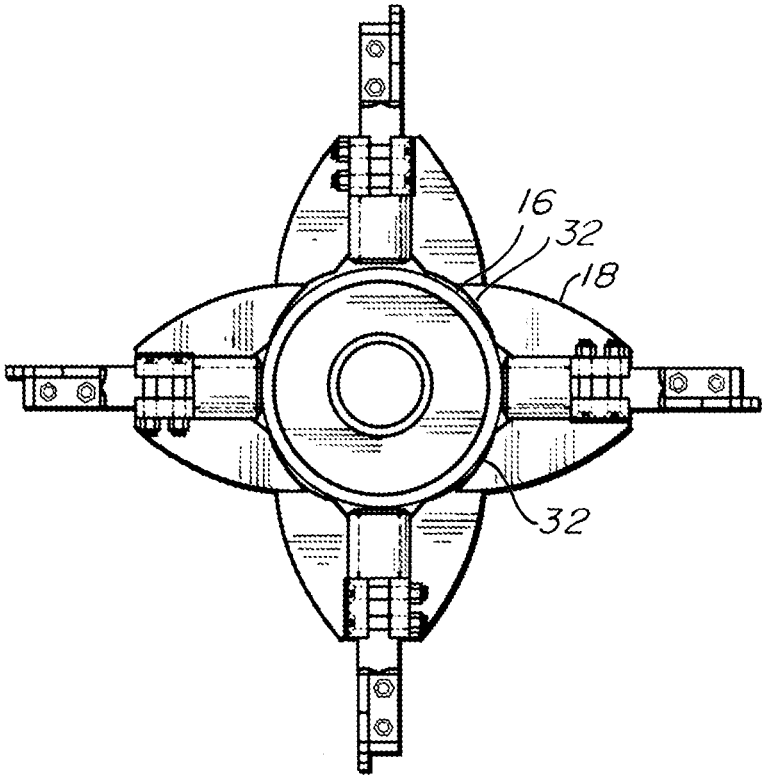
FIG. 11 is an end elevation view with selected interior details of at least one exemplary embodiment of a separator/grinding apparatus, including a shaft or drum having four paddle assemblies extending radially therefrom, in accordance with the present disclosure.

As depicted in FIGS. 2 and 5, it should be noted that each gusset 18 may include a first exterior edge 30 (e.g., a first arcuate exterior edge) and a second engagement edge 32 (e.g., a second arcuate engagement edge). As shown in FIG. 11, in one or more embodiments, the second engagement edge 32 may be preferably permanently engaged to the exterior surface of the rotatable shaft or drum 16 by welding, which may be disposed centrally within the grinding/separator chamber (e.g., grinding/separator apparatus cylinder) (not shown).

In at least one embodiment, at least one gusset 18 is permanently attached to the rear face of support plate 21 by welding. In some embodiments, at least one gusset 18 is permanently affixed to shaft 16 by welding along the second engagement edge 32. In alternative embodiments, at least one gusset 18 is permanently attached to both the rear face of support plate 21, and shaft 16 along the second engagement edge 32 by welding or other permanent attachment devices, members or techniques.

Figure 10:
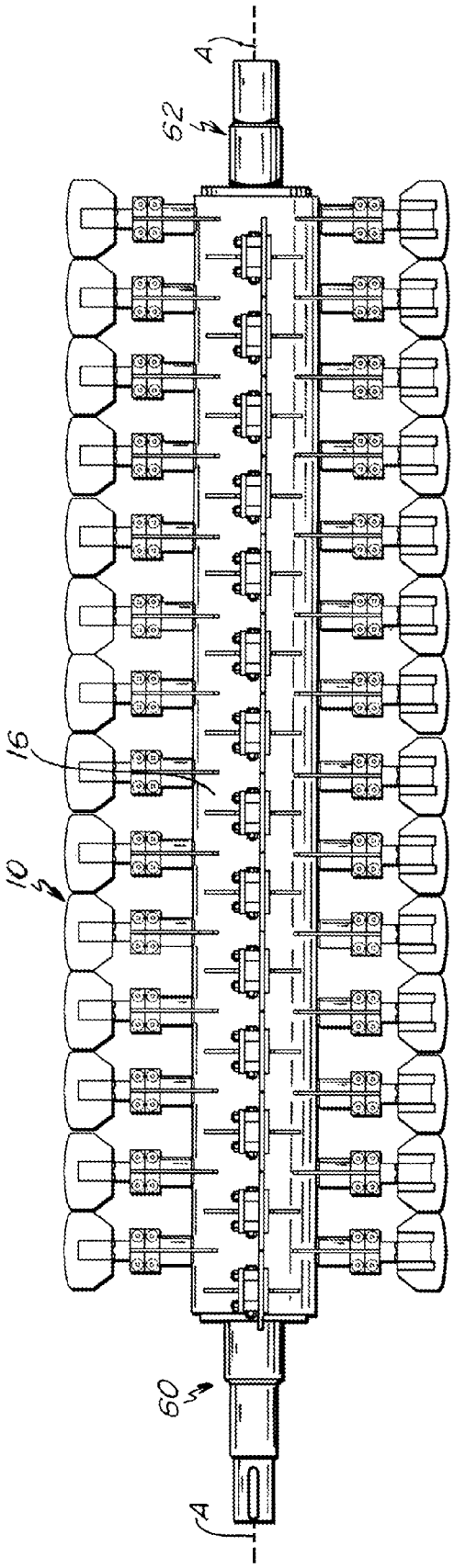
FIG. 10 is an elevation view of at least one exemplary embodiment of a separator/grinding apparatus, including a shaft or drum having a plurality of paddle assemblies extending radially therefrom, in accordance with the present disclosure.

In at least one embodiment, as depicted in FIG. 2, at least one gusset 18 is permanently attached collar 12 along vertical edge 31 by welding or other permanent attachment devices, members or techniques. In some embodiments, a gap or space 29 exists between support plate 20 and the upper interior edge portion of gusset 18. In alternative embodiments, the gap or space 29 facilitates placement of pin 28 into collar 12 and the positioning of support plate(s) 20 interior to a gusset 18 along the forward side of paddle assembly 10. For example, as depicted in FIGS. 10 and 11, a gusset 18 may be securely positioned for alignment substantially perpendicular to the longitudinal axis A of the rotatable shaft or drum 16 (i.e., a major surface of the gusset 18 may represent a plane that is normal to the longitudinal axis of the rotatable shaft or drum). In one or more alternative embodiments, the gussets 18 may be permanently disposed at any desired angle relative to, and/or offset from, the direction of the longitudinal axis for the rotatable shaft or drum 16.

Figure 8:
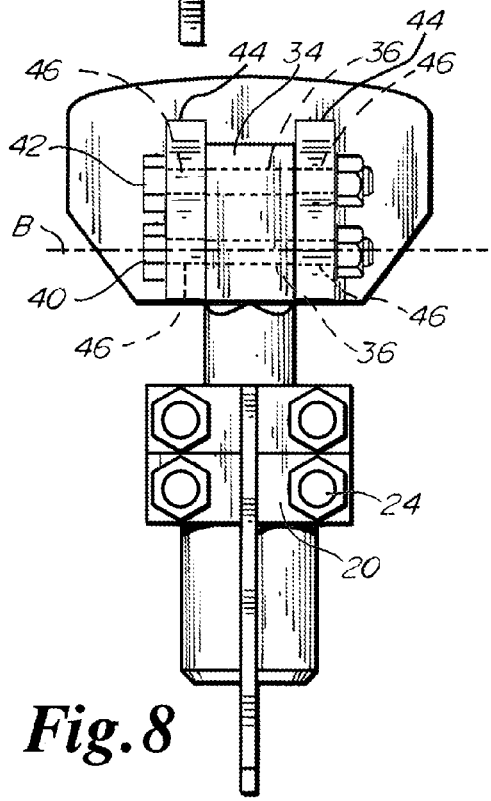
FIG. 8 is a rear elevation view, showing selected interior details, of at least one exemplary embodiment of a paddle assembly in accordance with the present disclosure.

In one or more embodiments of the present disclosure, as may be seen in FIG. 1, the pin 28 may include a permanently attached head 34. Head 34 may take a wide variety of suitable shapes including, but not limited to, a square prism, rectangular prism, etc. As shown in FIG. 8, head 34 also may include one or more apertures 36 extending through head 34. In one or more embodiments, one or more apertures 36 may extend in a direction or axis (e.g., longitudinal axis B) that is parallel to a first face 38 of paddle 10 (e.g., to a plane as defined by first face 38 of paddle 10). In one or more embodiments, one or more apertures 36 may extend in a direction or axis (e.g., longitudinal axis B) that is perpendicular to a longitudinal axis C of pin 28 or an axis parallel thereto. The dimensions for the head 34 of pin 28 may be increased and/or decreased or of any size as desired, provided that the size selected is sufficiently large to accommodate one or more apertures 36, at least one of which may be adapted to receive, for example, a pivot bolt 40. In one or more embodiments, the head 34 of pin 28 may be sized sufficiently large to accommodate one or more apertures, at least one of which may be adapted to receive, for example, a shear bolt 42.

One of skill in the art will recognize that head 34 may take any of a wide variety of shapes and may be formed of one or a variety of metallic or composite materials including carbon steel. In at least one embodiment, at least one side plate 44 may be disposed adjacent to head 34. The at least one side plate 44 may take any of a wide variety of shapes, provided that the at least one side plate 44 does not obstruct the rotation of paddle 11 about pivot member 40 upon the fracture of shear member 42. In at least one embodiment, side plate 44 may be formed of one or a variety of metallic or composite materials including 304 stainless steel.

In one or more embodiments, as may be seen in FIG. 1, paddle assembly 10 may include a second paddle face 39 and one or more side plates 44 (e.g., a pair of spaced apart side plates 44), which may be welded to the second paddle face 39 in, for example, a vertical orientation. Side plates 44 may be preferably separated from each other and may be adapted for positioning adjacent and exterior to opposite sides of the head 34 of pin 28. As shown in FIG. 8, each side plate 44 may preferably include one or more apertures 46 (e.g., a pair of aligned apertures 46). Each pair of aligned apertures 46 may be preferably adapted for positioning adjacent to a pair of apertures 36 traversing head 34.

In one or more embodiments, as may be seen in FIG. 8, a pivot member 40 (e.g., a pivot bolt) may extend through (e.g., traverse) at least one aperture 46 (e.g., aperture 46 of the a first side plate 44 and another aperture 46 of a second side plate 44) and at least one aperture 36 adjacent to lower section of head 34 (e.g., in the proximal portion of head 34). In at least one embodiment, a shear member 42 may pass (e.g., extend) through one or more apertures 46 (e.g., a pair of aligned apertures 46) and one or more apertures 36 proximate to the top of the paddle assembly 10 (e.g., distal of the pivot member). In one or more embodiments, one or more of the apertures of the head 34 and/or the side plates 44 may extend partially through head 34 or side plate 44 and may be a recess into which a shear member 42 or pivot member 40 may extend.

Figure 3:
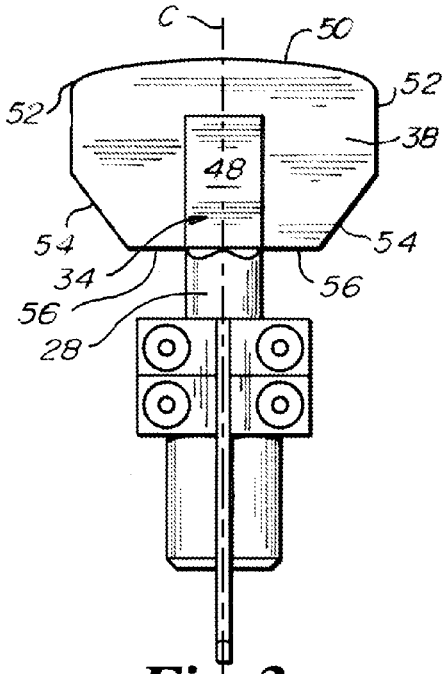
FIG. 3 is a front elevation view of at least one exemplary embodiment of a paddle assembly in accordance with the present disclosure.
Figure 4:
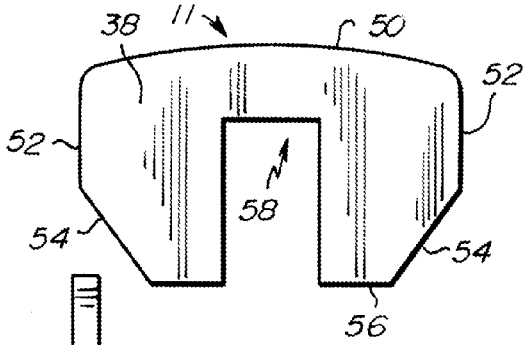
FIG. 4 is a detail view of at least one exemplary embodiment of a paddle, which may be utilized in one or more embodiments of the present disclosure.

It should be noted that, in one or more embodiments, one or more dimensions of the apertures through which the pivot member 40 extends (e.g., apertures 46 extending through side plates 44 and/or aperture 36 extending through head 34 of pin 28) may be increased relative to a corresponding one or more dimensions of the apertures through which the shear member 42 extends (e.g., apertures 46 extending through side plates 44 and/or aperture 36 extending through head 34 of pin 28). In one or more embodiments, making reference to FIG. 3, head 34 of pin 28 may preferably include a striking face 48. Also, as seen in FIGS. 3 and 4, first face 38 of paddle 11 of paddle assembly 10, in at least one embodiment, may include a distal edge 50 (e.g., a slightly arcuate top edge), a pair of exterior edges 52 (e.g., a pair of substantially parallel exterior edges) each extending from an end of the distal edge 50, a pair of angled edges 54 (e.g., a pair of complementary or mirror image edges) and a proximal edge 56 (e.g., a bottom edge). First face 38 of paddle 11 of paddle assembly 10 may also preferably include a slot 58, which may take any suitable shape (e.g., rectangular) and may be adapted to receive or be positioned adjacent to striking face 48 of head 34 and/or to receive head 34 of pin 28 in slot 58.

Unless otherwise noted, in the present disclosure, "distal" refers to a direction as shown in FIG. 2 or a portion of a paddle 11 or paddle assembly 10 that would extend away from a rotatable shaft or drum 16, whereas "proximal" refers to a direction as shown in FIG. 2 or a portion of a paddle 11 or paddle assembly 10 that extends toward or is nearer to a rotatable shaft or drum 16. For example, in one or more embodiments depicted in FIG. 1, head 34 is distal of pin 28, and gussets 18 are proximal of paddle 11.

In one or more embodiments, paddle 11 may include a first side (e.g., first face 38), head 34 may include a first side (e.g., striking face 48), and first side of paddle 11 and first side of head 38 may collectively form a striking surface. As shown in FIGS. 2 and 3, first side (e.g., first face 38) of paddle 11 may be adjacent to the first side (e.g., striking face 48) of head 34. One of skill in the art will recognize that material to be processed may contact other surfaces of paddle assembly 10, depending on the paddle configuration, rotational direction of the rotatable shaft or drum 16, etc.

In one or more embodiments, the plurality of radially projecting members (e.g., paddle assemblies) may be constructed and arranged in the chamber to grind a material to be processed. For example, during use of paddle assembly 10 within a grinder/separator apparatus, shaft 16 will rotate (e.g., at high speed) wherein paddle assembly 10, including first face 38 and striking face 48, will contact material to be processed (e.g., waste material) in the chamber at a speed sufficient to separate and reduce the material (e.g., waste material) for further processing or use. In general, first face 38 and striking face 48 will contact the material (e.g., waste material) in the manner similar to a hammer mill to reduce the material (e.g., waste material) to particles/portions of a desired size. In one or more embodiments, the material to be processed (e.g., waste material) may be relatively hard (or may otherwise be of a consistency sufficient to obstruct the rotational movement of paddle 11), the contact of which against paddle 11 may cause shear bolt 42 to fracture, permitting first face 38 and side plate(s) 44 to pivot downwardly (e.g. proximally) and backwardly (e.g., in a rotational direction opposing the rotational direction of the rotatable shaft or drum 16) relative to head 34 in order to minimize damage to paddle assembly 10. When sufficient force is applied to paddle 11 (e.g., first face 38) to result in the fracture of the shear bolt 42, the striking face 48 of the head 34 of pin 28 will continue to strike material to reduce the material to a desired size during use of the paddle assembly 10 within the interior of a grinder/separator as rotated by rotatable shaft or drum 16.

In one or more embodiments, shear member 42 (e.g., shear bolt) may be constructed and arranged to fracture upon application of a predetermined amount of shear force to the shear member 42 as a result of application of a corresponding force to the paddle 11 or paddle assembly 10. In one or more embodiments, the corresponding force applied to paddle 11 may be insufficient to cause damage to the radially projecting member in excess of fracturing the shear member 42. In at least one embodiment, in the event that pin 28 and/or striking face 48 are subject to damage, then support plate 20 may be released from engagement to rear support plate 21 permitting pin 28 to be withdrawn from engagement with collar 12. Pin 28, including head 34 and striking face 48, may be replaced with an undamaged pin 28, head 34, and striking face 48 by release of nuts and bolts 24 and removal of the damaged pin 28 from collar 12. Re-attachment of an undamaged pin 28, head 34 and striking face 48, to collar 12 make occur by reconnection of support plate 20 to rear support plate 21 through the use of bolts and nuts 24 or other fastening members. It should be noted that a damaged paddle 11 may be replaced upon removal of pivot member 40 and/or shear member 42 for connection of an undamaged paddle 11 to head 34 as earlier described.

In one or more embodiments, the shape of head 34 and the shape of slot 58 may be configured to allow, for example, pivotal rotation of paddle 11 relative to head 34 in at least one rotational direction (e.g., the rotational direction opposite of the rotational direction of rotatable shaft or drum 16). For example, in FIG. 11, the rotatable shaft or drum 16 may rotate clockwise about a longitudinal axis A (see FIG. 10) extending lengthwise through the center of rotatable shaft or drum 16, whereas upon fracturing of shear member 42 (e.g., shear bolt), paddle 11 may rotate counterclockwise about a longitudinal axis B (see FIG. 8) defined by pivot member 40 (e.g., pivot bolt). As shown in FIGS. 2 and 11, paddle 11 may be prevented from rotating clockwise about the pivot member 40 beyond a first position (e.g., a grinding configuration) when a shear member 42 is in place. When a shear member 42 is fractured and/or not present, the paddle 11 and side plates 44 would be free to rotate counterclockwise about the pivot member 40 from the first position (e.g., a grinding configuration) to a second position wherein the paddle 11 or side plate 44 contacts another portion of the paddle assembly 10 that obstructs further rotation (e.g. further counterclockwise rotation in FIG. 11). In one or more embodiments, paddle 11 may rotate clockwise from the second position toward, but not past the first position (e.g., obstructed by, for example, the proximal facing portion of slot 58 contacting the proximal facing surface of head 34).

Figure 6:
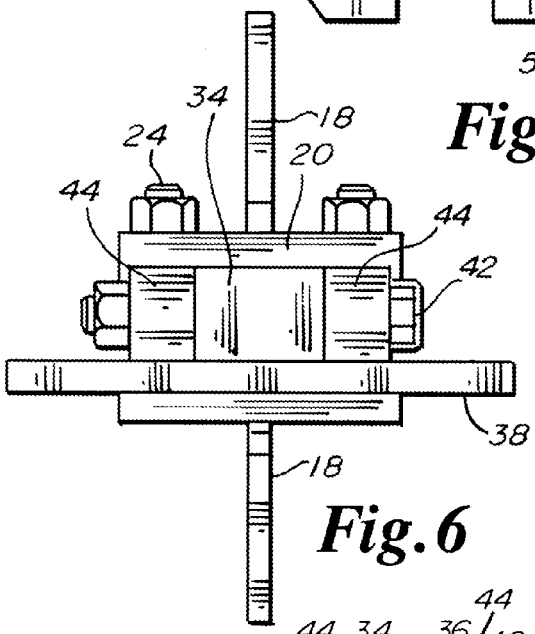
FIG. 6 is a top view of at least one exemplary embodiment of a paddle assembly in accordance with the present disclosure.

As may be seen and FIGS. 7 and 8, one or both of support plates 20 may include at least one recessed surface for insertion of connecting members (e.g., bolts and nuts 24) therein. In the present disclosure, connecting members may take any of a wide variety of forms, provided that they collectively secure the support plates 20 to rear support plate 21 and pin 28 (e.g., to opposite sides of pin 28). For example, connecting members, such as bolts and nuts 24, may include a hexagonally-shaped head end, as shown in FIG. 6, may include a recessable head end, as shown in FIGS. 2 and 7.

In one or more embodiments, paddle assembly 10 or portions thereof may be formed of a carbon steel, stainless steel, and/or 304 stainless steel. In alternative embodiments, paddle assembly 10 or portions thereof may be formed of a hardened steel or other types of hardened or composite material (e.g., metal, ceramic, polymer, etc.) of sufficient durability to withstand the internal forces (e.g., impact forces) for separating and reducing material (e.g., waste material) within a separator/grinding apparatus (e.g., having a cylindrical chamber) during rotation of rotatable shaft or drum 16 at, for example, high rotational rates or high paddle speeds.

Figure 12:
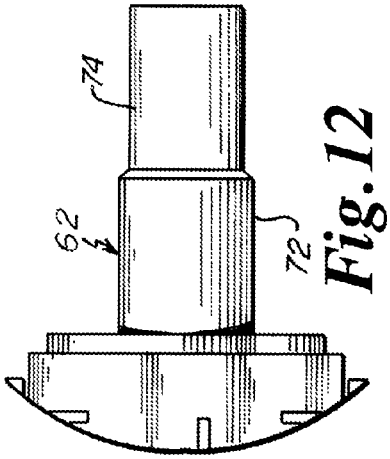
FIG. 12 is a detail elevation view of at least one exemplary embodiment of a second end assembly in accordance with the present disclosure.
Figure 9:
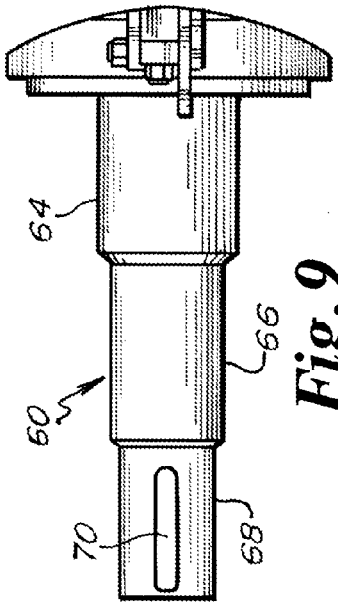
FIG. 9 is a detail elevation view of at least one exemplary embodiment of a first end assembly in accordance with the present disclosure.

As depicted in FIGS. 9, 10, and 12, rotatable shaft or drum 16 may include a first end assembly 60 and a second end assembly 62. First end assembly 60 and second end assembly 62 may take any of a wide variety of forms known to one of skill in the art. For example, first end assembly 60 may include a first end engagement portion that operatively engages a first end of the rotatable shaft or drum 16, a first cylindrical proportion 64 extending from the first end engagement portion, an intermediate cylindrical portion 66 extending from the first cylindrical portion 64, and an end cylindrical portion 68, extending from the intermediate cylindrical portion 66 and including a slot 70. The second end assembly 62 may include a second end engagement portion that operatively engages a second end of the rotatable shaft or drum 16, a first cylindrical portion 72 extending from the second end engagement portion, and an end cylindrical portion 74 extending from the first cylindrical portion. In at least one embodiment, first end engagement portion of first end assembly 60 may be engaged to the rotatable shaft or drum 16 proximate to first cylindrical proportion 64. In one or more embodiments, end cylindrical portion 68 may be operatively engaged to a motor or engine capable of imparting rotation (e.g., high-speed rotation) to rotatable shaft or drum 16 and the one or more paddle assemblies 10 engaged therewith to process materials (e.g., waste materials). In at least one embodiment, second end engagement portion of second end assembly 62 may be engaged to a second end (e.g., an end opposing the first end) of rotatable shaft or drum 16 proximate to first cylindrical portion 72. In one or more embodiments, end cylindrical portion 74 of second end assembly 62 may be preferably engaged to a bearing assembly, which may be integral to an exterior wall of a separator/grinding apparatus, to permit the rotation (e.g., high-speed rotation) of rotatable shaft or drum 16.

In one or more embodiments, as may be seen in FIG. 10, a plurality of paddle assemblies 10 may be permanently and/or removably engaged (e.g., affixed, adhered, connected, etc.) to rotatable shaft or drum 16 and configured into, for example, aligned rows and/or columns (e.g., rows along the length of the rotatable shaft or drum 16, columns around the circumference of the rotatable shaft or drum 16). In one or more embodiments, paddle assemblies 10 may be permanently or releasably engaged to rotatable shaft or drum 16 in offset rows or columns as desired. In addition, rotating shaft 16 may accommodate any arrangement or configuration of paddle assemblies 10 as desired, including but not limited to spiral and/or helical configurations as desired.

In the present disclosure, paddle assemblies 10 and/or radially projecting members may be used in a wide variety of applications and for a wide variety of purposes, such as in conjunction with a particulate separator apparatus; a grinding apparatus; single-pass material processing apparatus; a cooling apparatus; a drying apparatus; a hammer mill; and/or any combination thereof.

In one or more embodiments wherein a paddle assembly 10 is engaged to a rotatable shaft or drum 16, a paddle 11 of the paddle assembly 10 may have a first face, wherein the first face may be angled relative to the longitudinal axis of the rotatable shaft or drum 16 between approximately 10 to 25 degrees, or more than 25 degrees, or less than 10 degrees.

In one or more embodiments of the present disclosure, the paddles 11 and/or paddle assemblies 10 may be grouped into, and positioned along the rotatable shaft or drum 16 into one or more sections. For example, the length of the pins 28 for each paddle assembly 10 may vary between paddle assemblies or groups of paddle assemblies or sections of paddle assemblies. In addition, the size and shape of the first face 38 of paddle 11 may vary for each paddle 11 and/or may vary between paddle assemblies 10 or groups of paddle assemblies or sections of paddle assemblies. For example, the paddles in each section may have a predetermined length, the predetermined length of the paddles in one section having an increased or decreased length or size dimension as compared to another section. One of skill in the art may envision other dimensions or characteristics of the paddle assembly components (e.g., shear member diameter, paddle length, paddle width, paddle thickness, paddle shape, distance between paddle assemblies, arrangement of paddle assemblies, etc.) that may be increased, decreased, or otherwise modified in one section as compared to another section of paddle assemblies.

The rotatable shaft or drum 16, in one or more embodiments, may be constructed to rotate at a predetermined rate up to about 2300 revolutions per minute (rpm) (e.g., from about 500 rpm to about 2300 rpm). In one or more embodiments, the rotatable shaft or drum 16 may be constructed to rotate greater than 2300 rpm. In one or more embodiments, the rotatable shaft or drum 16 may be constructed to rotate less than 500 rpm.

In one or more embodiments, pin 28 of paddle assembly 10 may include a threaded portion (e.g., a threaded neck portion) adapted for engagement into the rotatable shaft or drum 16, such that paddle assembly 10 may be rotated to achieve a desired or selected pitch (e.g., angle) relative to the rotatable shaft or drum 16. In one or more embodiments, each paddle assembly 10 may be rotated a desired distance into the rotatable shaft or drum 16, wherein the distance may be the same or different from one or more other paddle assemblies or sections of paddle assembles as engaged to the rotatable shaft or drum 16. In some embodiments, paddle assembly 10 may be releasably secured in the desired or selected pitch by engagement with support plates 20 (e.g., tightening support plates 20 to pin 28 and collar 12) and/or any of a wide variety of manners known to one of skill in the art. In one or more embodiments, pin 28 may include a threaded portion for engagement into collar 12, which may be engaged with the rotatable shaft or drum 16 by, for example, welding or another threaded or non-threaded engagement. Alternatively, pin 28 may be releasable fixedly engaged with collar 12, for example, by engagement with support plates 20, 21 to pin 28 as disposed in collar 12 and/or by any of a wide variety of manners known to one of skill in the art, wherein the collar 12 may include a threaded portion for engagement into a threaded portion of rotatable shaft or drum 16. Paddle assembly 10 may then be releasably secured in a desired or selected pitch by, for example, adjusting the angle of engagement of paddle 11 with the rotatable shaft or drum 16.

In at least one embodiment, the interior of collar 12 is smooth, and the exterior of pin 28 is smooth, where the exterior of pin 28 is constructed and arranged for positioning within the interior of collar 12 for releasable affixation thereto. The use of support plates 20, 21 functioning as clamps, may be used to releasably secure pin 28 and paddle 11 to collar 12. In some embodiments, collar 12 is permanently attached to shaft 16 by welding or other permanent attachment devices, members or techniques, and gusset 18 may be permanently attached to both collar 12 and shaft 16 by welding or other permanent attachment devices, members or techniques.

In one or more embodiments, the grinding/separator apparatus may include a gate, wherein the separator/grinding apparatus chamber further includes an opening (e.g., an opening that extends from the chamber through the inside wall) selectively coverable by the gate. The gate may be operatively engaged with the chamber in a wide variety of manners known to one of skill in the art. For example, the gate may be pivotally engaged to the chamber and may have an open position wherein the opening is at least partially uncovered (e.g., completely uncovered) and a closed position wherein the opening is covered (e.g., complete covered). In one or more embodiments, an exemplary gate may be an access door, which may be adapted to allow an individual to access and replace a shear member 42 (e.g., shear bolt) for one or more paddle assemblies 10; to replace or to remove a paddle assembly 10; to adjust the configuration of paddle assemblies 10; and/or to adjust the pitch or the position of the paddle assemblies 10.

Another aspect of the present disclosure is a method of maintaining a separator/grinding apparatus including replacing a fractured shear member 42 (e.g., shear bolt) with a replacement shear member 42 (e.g., a new shear member). The method may also include accessing the interior of a separator/grinding apparatus chamber through an opening by, for example, opening a gate. In one or more embodiments, instead of or in addition to replacing a fractured shear member 42 (e.g., shear bolt), an individual may replace or remove a paddle assembly 10 or portion thereof from collar 12; may adjust the configuration of one or more paddle assemblies 10; and/or may adjust the pitch and/or the position of one or more paddle assemblies 10. The method may further including moving the gate to a closed position wherein the opening in the chamber is covered (e.g., completely covered) by the gate.

The above disclosure is intended to be illustrative and not exhaustive. The present disclosure suggests many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein, which equivalents are also intended to be encompassed by the claims. While one or more preferred embodiments have been described in detail, it will be appreciated that the present disclosure comprehends other embodiments as well. For example, while less preferred, one or more paddles may take a different form than the one or more preferred forms described in detail herein and still be comprehended by the present disclosure.

All US patents and applications and all other published documents mentioned anywhere in this application are incorporated herein by reference in their entireties.

The particular features presented in the dependent claims can be combined with each other in other manners within the scope of the present disclosure such that the present disclosure should be recognized as also specifically directed to other embodiments having any other possible combination of the features of the dependent claims.

A brief abstract of the technical disclosure in the specification is provided as well only for the purposes of complying with 37 C.F.R. 1.72. The abstract is not intended to be used for interpreting the scope of the claims.

What is claimed is:

1. A paddle assembly comprising:

a pin having a head; and a paddle having a slot, a portion of said head being disposed in said slot, said paddle being engaged to the head by a pivot, the paddle assembly further comprising a shear member engaged to said paddle and to said head, said shear member being constructed and arranged to fracture to permit pivotal rotation of the paddle relative to the head about said pivot.

2. The paddle assembly according to claim 1, said paddle comprising a first side and a second side, the second side comprising a first side plate, said first side plate engaging said shear member.

3. The paddle assembly of claim 2, wherein the second side comprises said first side plate and a second side plate, said first side plate and said second side plate being disposed on opposite sides of said head, said pivot pivotally engaging said first side plate and said second side plate to the head.

4. The paddle assembly of claim 1, wherein the head comprises a first aperture, the paddle comprises a second aperture, the shear member extending through the first aperture and the second aperture.

5. The paddle assembly of claim 4, wherein the second aperture is disposed through the first side plate.

6. A paddle assembly comprising:

a pin;

a paddle having a slot, at least a portion of said pin being disposed in said slot, said pin being engaged to said paddle by a pivot; and a shear member engaged to the pin and to the paddle, the shear member constructed and arranged to fracture to permit pivotal rotation of the paddle relative to the pin about said pivot.

7. The radially projecting member of claim 6, wherein said pin has a head, said paddle is pivotally engaged to the head, and said shear member is engaged to the head and to the paddle.

8. The radially projecting member of claim 7, wherein the paddle comprises a first side, the head comprises a first side, wherein the first side of the paddle and the first side of the head collectively form a striking surface.

9. The radially projecting member of claim 7, wherein said head is disposed in said slot.

10. A paddle assembly comprising:

a pin; and a paddle having a slot, at least a portion of said pin being disposed in said slot, said pin being engaged to said paddle by a pivot and a shear member, said shear member having an unfractured configuration and a fractured configuration, said paddle being pivotally engaged to the pin when the shear member is in the fractured configuration.

11. The paddle assembly according to claim 10, wherein said pin has a head, said paddle having a first side and a second side, the second side having at least one side plate, the side plate being fixedly attached to the head when the paddle assembly is in the unfractured configuration and pivotally engaged to the head when the paddle assembly is in the fractured configuration.

* * * * *